United States Patent [19]

Waters

[11] Patent Number: 4,577,919

[45] Date of Patent: Mar. 25, 1986

[54] BOOT AND SHIELDED CABLE CONNECTOR

[75] Inventor: Mark H. Waters, Harrisburg, Pa.

[73] Assignee: AMP Incorporated, Harrisburg, Pa.

[21] Appl. No.: 703,020

[22] Filed: Feb. 19, 1985

[51] Int. Cl.[4] ..... H01R 13/621

[52] U.S. Cl. ..... 339/59 M; 339/92 M; 339/206 R

[58] Field of Search ..... 339/92 R, 92 M, 206 R, 339/206 P, 59 M, 59 R, 60 C, 60 M, 94 M, 61 M, 62, 63 R, 63 M

[56] References Cited

U.S. PATENT DOCUMENTS

| | | | |
|---|---|---|---|
| 2,746,022 | 5/1956 | Gilbert | 339/92 |
| 2,902,665 | 9/1959 | D'Amico | 339/184 |
| 3,030,602 | 4/1962 | Jackson et al. | 339/92 M |
| 3,573,677 | 4/1971 | Detar | 333/79 |
| 3,760,336 | 9/1973 | Cerwin | 339/92 M |
| 4,460,230 | 7/1984 | McKee et al. | 339/92 M |

FOREIGN PATENT DOCUMENTS

| | | | |
|---|---|---|---|
| 955632 | 4/1964 | United Kingdom | 339/94 M |
| 2088150 | 6/1982 | United Kingdom | 339/92 R |

*Primary Examiner*—John McQuade
*Attorney, Agent, or Firm*—F. Brice Faller

[57] ABSTRACT

Boot assembly for use with a shielded cable connector having a flange about the periphery of the mating face comprises jack screws passing through the cable receiving end of the boot and the flange to retain the connector against a complementary connector. Boot is molded of a thermoplastic having good elongation in thin sections so that screw receiving apertures in boot capture screws at constricted necks thereof and cable receiving aperture will accommodate wide range of cable sizes.

3 Claims, 10 Drawing Figures

BOOT AND SHIELDED CABLE CONNECTOR

FIELD OF THE INVENTION

The present invention relates to a dielectric boot for a shielded cable connector.

BACKGROUND OF THE INVENTION

Shielded cable connectors of the type sold by AMP Incorporated in its AMPLIMITE line of connectors are popular for terminating individually insulated conductors. Historically, connectors of this type have been assembled to multiconductor cable having a metal shielding braid in several ways. According to one method, the individual conductors are terminated to terminals in the connector, plastic is premolded onto the conductors, metal foil is wrapped about the premold, and plastic is postmolded (overmolded) onto the foil, yielding a finished connector with an exposed mating face and the cable emerging from the overmold opposite the mating face. More recently, a connector shield in the form of stamped and formed metal shell in two halves has been applied to the terminated connector and the plastic is overmolded onto the shell as taught in U.S. patent application Ser. No. 682,045. The overmolding procedure, while effective, requires injection molding equipment and attendant capital expenditure beyond the reach of the small manufacturer. Accordingly, a dielectric boot which could be received over the shielded connector would be desirable for small production runs.

U.S. Pat. No. 4,063,793 discloses an elastomeric boot assembly for a cable connector of the type having a mating face and an opposed cable receiving face, the boot having an open connector receiving end and an opposed cable receiving end. The boot is received on the connector by sliding it over a cable terminated thereto, the cable being received through a cable receiving aperture in the cable receiving end, the mating face remaining exposed through the connector receiving end of the boot.

The above described boot is not adapted for use with a shielded connector with a flange through which screws are received for retaining the connector against a complementary connector. It would be desirable to design such a boot where such screws are received therethrough after the boot is assembled to the connector, and further, to retain the screws in the assembly when not mated.

SUMMARY OF THE PRESENT INVENTION

According to the invention, therefore, a boot assembly as described above is characterized in that it is adapted for use with a shielded cable connector of the type having a flange about the periphery of the mating face. The assembly comprises screw means passing through the cable receiving end of the boot and the flange to retain the connector against a complementary connector. The screw means comprises at least one screw having a threaded end, an opposed head, and an enlarged shank therebetween. The shank has a first shoulder facing the threaded end and a second shoulder facing the head, the second shoulder and the head defining a constricted neck therebetween. The boot has a cable receiving aperture therein which receives the screw therethrough so as to align with a hole in the flange. The screw receiving aperture is sized to closely receive the constricted neck, the aperture being expansible to receive the enlarged shank portion therethrough.

The boot is assembled to the connector by use of a special tool which expands the cable receiving aperture and inserts a sleeve through which the cable is fed. The tool is then removed and a crimp ferrule is fed over the cable. The cable is then stripped, the individual conductors therein are terminated to the connector, the shield and crimp ferrule are applied, the boot is slipped over the shield, and the jack screws are inserted through the screw receiving apertures so that the threaded ends protrude through the holes in the flange. The constricted neck is captured in the screw receiving aperture in the boot, and the first shoulder bears against the flange to draw the connector to a complementary connector as the head is rotated.

DETAILED DESCRIPTION OF THE PREFERRED EMBODIMENT

Figures 1, 2:
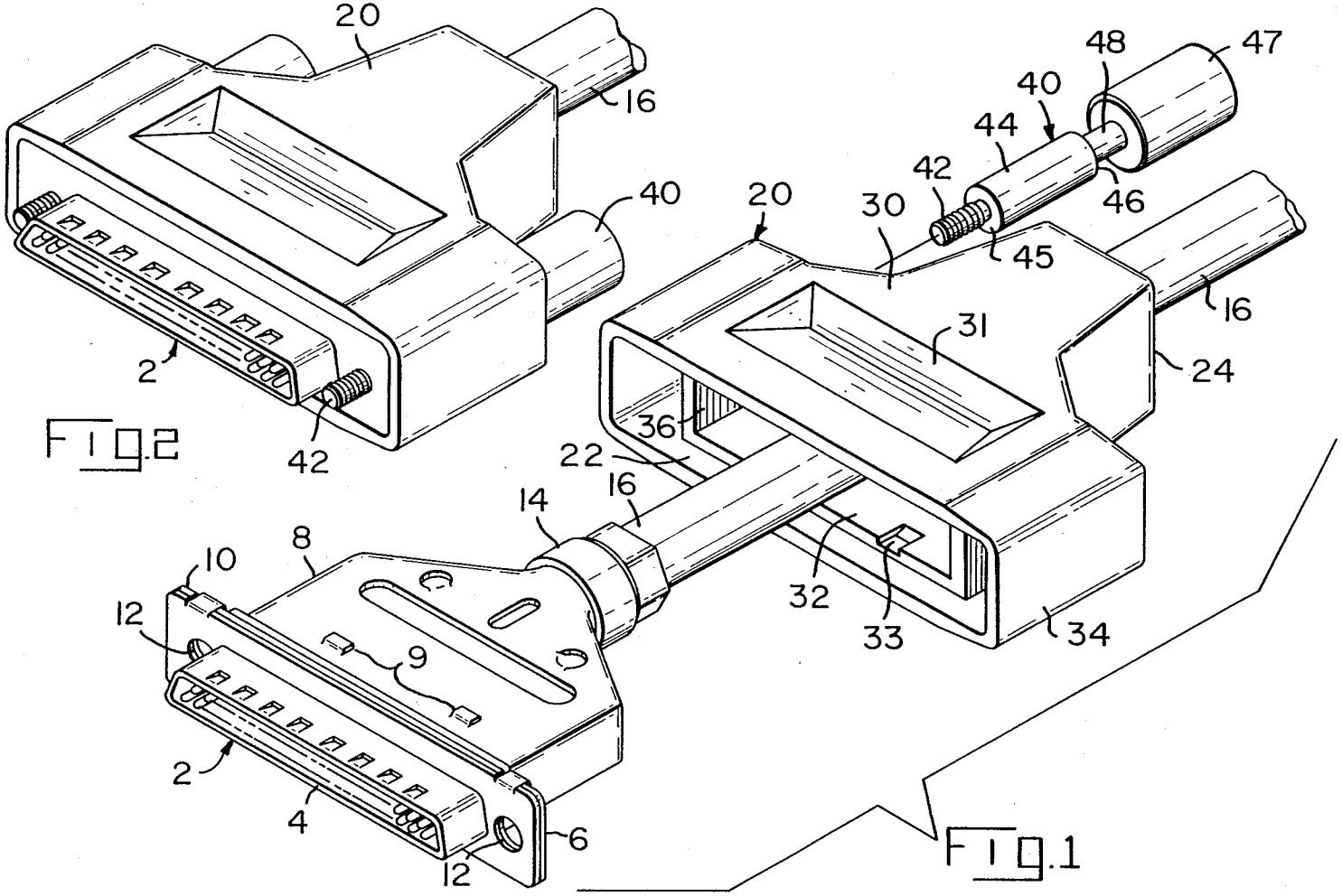
FIG. 1 is an exploded perspective of the boot and connector.
FIG. 2 is a perspective of the connector with boot assembled thereto.

Referring to FIG. 1, the connector comprises a mating face 4, an opposed cable receiving face 6, and a stamped and formed two-part metal shield 8 fixed thereto as taught in U.S. patent application Ser. No. 682,045. The connector has a metal flange 10 with a pair of holes 12 therethrough which receive jack screws to retain it to a complementary connector. A shielded cable 16 is fixed to shield 8 by means of a crimped ferrule 14 as taught in application Ser. No. 682,045, which is hereby incorporated by reference. The boot 20 has an open connector receiving end 22, an opposed cable receiving end 24, and opposed outer sidewalls 30 and opposed outer endwalls 34 extending therebetween. Inner sidewalls 32 are molded against outer sidewalls 30 and recessed from connector receiving end 22 to receive the flange 10 flushly within end 22; indents 33 in inner sidewalls 32 receive detents 9 on the shield 8. A pair of inner endwalls 36 are each spaced sufficiently far from the adjacent outer endwall 34 to receive a jack screw 40 in the intervening space. The inner sidewalls 32 and inner endwalls 36 are spaced to closely receive the shield 8. Jack screws 40 each comprise a threaded end 42, an opposed head 47, and an enlarged shank 44 therebetween. The shank 44 has a first shoulder 45 facing end 42 and a second shoulder 46 facing head 47 to define a constricted neck 48 between the shank 44 and head 47.

FIG. 2 shows the boot 20 as assembled to connector 2 in a friction fit made possible by the resilience of the boot. The preferred material is a thermoplastic elastomer sold by The Shell Oil Company under the tradename Elexar; this is a styrene ethylene-butylene styrene block copolymer with hydrocarbon oil, polypropylene, stabilizers and flame retardants added. This material is flame retardant, v-o rated, has high impact strength, and good elongation in thin sections. The elongation property gives the apertures which receive the jack screws and cable good compliance as will be described.

Figure 3:
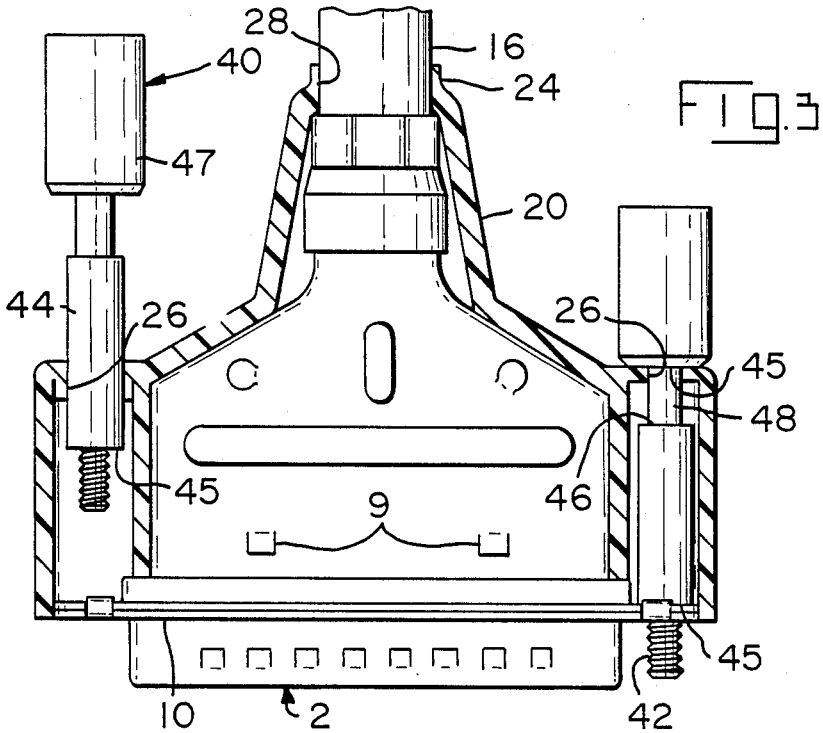
FIG. 3 is a side cross section of the connector with boot assembled thereto.

FIG. 3 is a side section view showing the boot 20 on connector 2. A cable receiving aperture 28 in cable receiving end 24 is expanded to closely receive the cable 16 therethrough in a good sealing fit made possible by the preferred material, which permits molding a small aperture which will accommodate a wide range of cable sizes. Screw receiving apertures 26 in the cable receiving end 24 of boot 20 are likewise highly compliant. While molded to closely receive the constricted necks 48 in a sealing fit as shown on the right, they readily expand to receive the enlarged shank 44 during insertion, as shown on the left. Once inserted, the screws 40 are thus retained in the boot 20. While the threaded end 42 is shown protruding considerably beyond metal flange 10, it may be backed up until second shoulder 46 abuts the boot where it defines the aperture 26 without forcing the shank 44 back through the aperture or withdrawing the threaded end 42 from the flange 10. When the connector 2 is mated with a complementary connector, the threaded end 42 is received in nut means associated with the complementary connector. The first shoulder 45 bears against the back of flange 10 as the head 47 is rotated to draw the connector 2 to the complementary connector.

Figure 4:
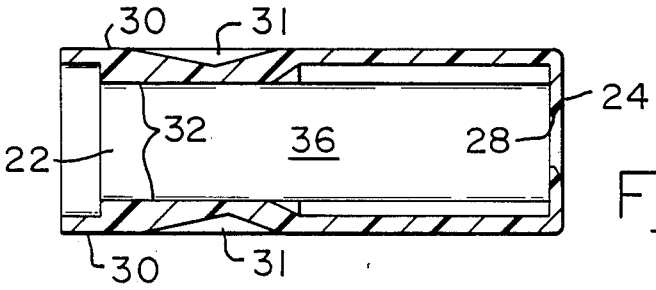
FIG. 4 is an end section of the boot.

FIG. 4 is an end section view of the boot 20 taken through the inner sidewalls 32 and outer sidewalls 30, which are molded with gripping indents 31 to facilitate pushing the boot onto a connector. Note that the cable receiving end 24 is relatively thin in the vicinity of cable receiving aperture 28 to take advantage of the elongation property of the preferred material and provide compliance over a wide range of cable sizes. A wall thickness of 0.030 inches in the vicinity of aperture 28 permits a 0.19 inch diameter aperture 28 to expand to 0.480 inches to accommodate the tool as will be described, and subsequently accommodate cable up to 0.437 inches. Another embodiment has a 0.312 inch diameter cable receiving aperture which expands to 0.602 inches diameter. Thinner sections are more likely to tear and thicker sections are less compliant and tend to crush insulation on the cable. The thickness of the boot in the vicinity of screw receiving aperture 28 is 0.045 inches and the diameter of the undeformed aperture is 0.130 inches; a screw having a neck diameter of 0.125 and a shoulder diameter of 0.156 is readily accommodated.

Figure 5:
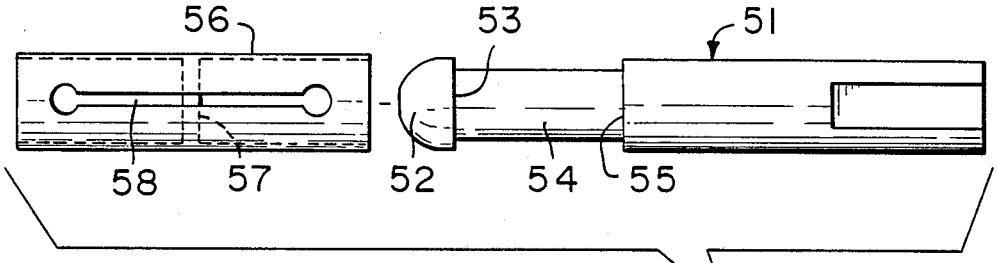
FIG. 5 is an exploded plan view of the tool.
Figure 5A:
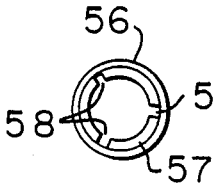
FIG. 5A is an end section view of the sleeve.

FIG. 5 shows the components of a two-part tool used to assemble the boot to a cable. A rod 51 comprises a hemispherical head 52, a rearward facing first shoulder 53, and a forward facing second shoulder 55 defining a constricted shank portion 54. A tubular sleeve 56 is machined from steel rod leaving an annular rib 57 on the inside surface. Three elongate slots 58 are provided in the sleeve 56 to permit radial expansion thereof when the annular rib 57 meets the head 52 of the rod 51 as the sheath 56 is received thereon. These features are apparent in the end view of FIG. 5A.

Figure 6:
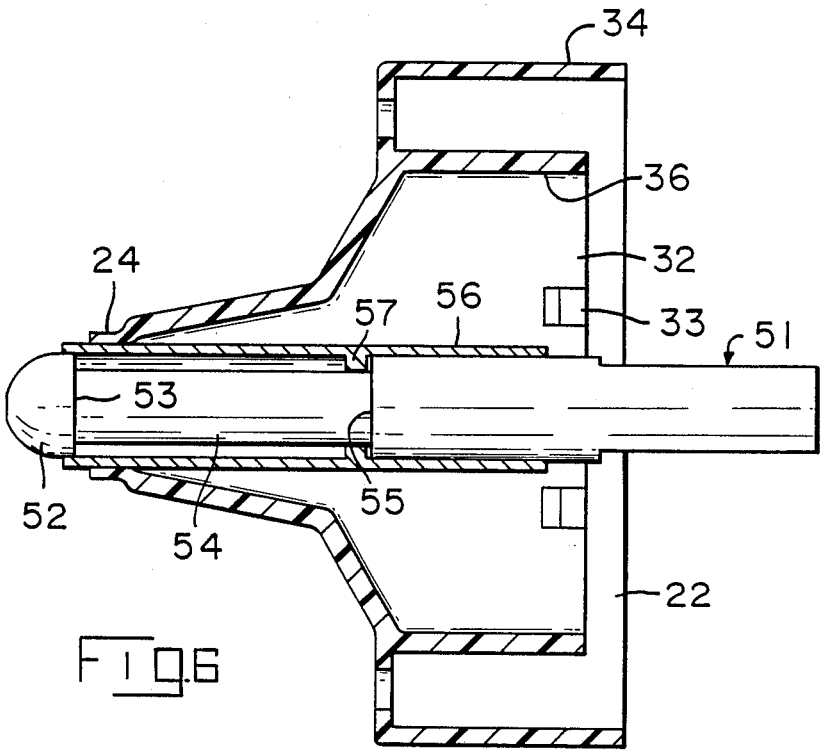
FIG. 6 is an end section showing the tool inserted in the boot.
Figure 7:
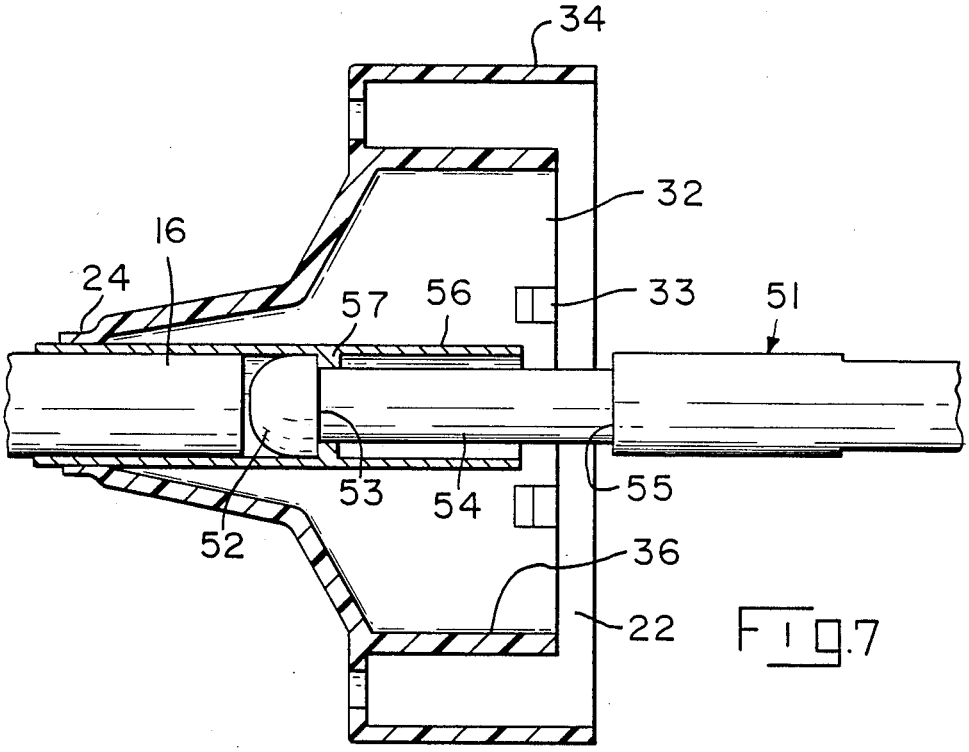
FIG. 7 is a end section showing the cable inserted into the tool sleeve.

FIGS. 6 to 9 depict the assembly sequence; FIG. 6 shows the tool 50 inserted through the cable receiving aperture 28 in boot 20 from the inside thereof, insertion being facilitated by the hemispherical head 52. The second shoulder 55 bears against annular rib 57 so that the sleeve 56 is also pushed through aperture 28; the rod 51 is then retracted until the first shoulder 53 abuts the rib 57. This permits insertion of a cable 16 into the sleeve 56, as shown in FIG. 7. The sleeve 56 has an inside diameter which will accommodate the largest cable diameter used, typically 0.437 inches. The outside sleeve diameter of 0.480 inches determines the maximum radial expansion of the aperture 28.

Figure 8:
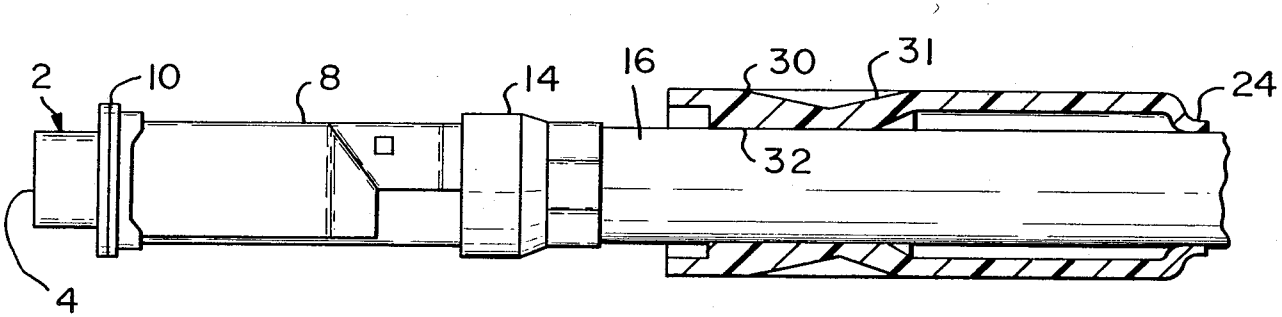
FIG. 8 is an end section showing the connector terminated to the cable.
Figure 9:
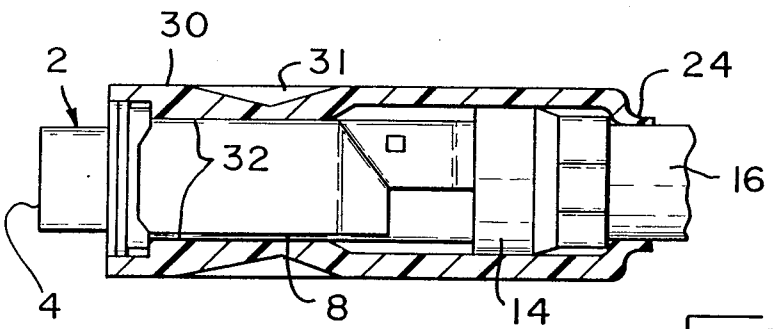
FIG. 9 is an end section of the boot assembled to the connector.

After the cable 16 is inserted in the sleeve 56, the tool 50 is removed from the boot 20 and the cable may be pushed further through aperture 28 to facilitate stripping the outer insulation and wire braid, and dressing out the individual conductors for termination. The crimp ferrule 14 is then slid over the cable 16 and the shield 8 is applied to yield a finished connector as shown in FIG. 8. FIG. 9 shows the boot 20 fully received on connector 2. The sidewalls 32 fit snugly against shield 8 for retention.

The foregoing is exemplary and not intended to limit the scope of the claims which follow.

I claim:

1. An elastomeric boot assembly combination with a cable and a cable connector of the type having a mating face and an opposed cable receiving face, the boot assembly comprising a boot having an open connector receiving end and an opposed cable receiving end, said boot being received on said connector by sliding over a cable terminated thereto, said cable being received through a cable receiving aperture in said cable receiving end, said mating face remaining exposed through said connector receiving end of said boot, characterized in that:

said boot assembly is adapted for use with a shielded cable connector of the type having a flange about the periphery of said mating face, said assembly further comprising screw means passing through said cable receiving end of said boot and said flange to retain said connector against a complementary connector, said screw means comprising at least one screw having a threaded end, an opposed head, and an enlarged shank therebetween, said shank having a first shoulder facing said threaded end and a second shoulder facing said head, said second shoulder and said head defining a constricted neck therebetween, said boot having a screw receiving aperture therein which receives said screw therethrough for alignment with a hole in said flange, said screw receiving aperture being sized to closely receive said constricted neck, said aperture being expansible to receive said enlarged shank portion therethrough, whereby upon assembling said boot to said connector and inserting said screw into said screw receiving aperture so that said threaded end extends through the hole in the flange, the constricted neck will be captured in said screw receiving aperture in said boot, the first shoulder bearing against said flange to draw the connector to a complementary connector as the head is rotated.

2. An elastomeric boot assembly combination as in claim 1 characterized in that said boot has opposed outer sidewalls and opposed outer endwalls, said screw means comprising two said screws, each said screw being received adjacent an outer endwall.

3. An elastomeric boot assembly combination as in claim 2 characterized in that said boot further comprises a pair of inner endwalls spaced from respective outer endwalls generally parallel thereto, said connector being received between said inner endwalls, each said screw being received between an inner endwall and the adjacent external endwall.

* * * * *